US008393607B2

(12) United States Patent
Masunari et al.

(10) Patent No.: US 8,393,607 B2
(45) Date of Patent: Mar. 12, 2013

(54) SHEET PROCESSING DEVICE

(71) Applicant: Gradco (Japan) Ltd., Tokyo (JP)

(72) Inventors: Kazushige Masunari, Tokyo (JP); Yumiko Kato, Tokyo (JP)

(73) Assignee: Gradco (Japan) Ltd., Tokyo (JP)

( * ) Notice: Subject to any disclaimer, the term of this patent is extended or adjusted under 35 U.S.C. 154(b) by 0 days.

(21) Appl. No.: 13/625,244

(22) Filed: Sep. 24, 2012

(65) Prior Publication Data

US 2013/0020750 A1 Jan. 24, 2013

Related U.S. Application Data

(62) Division of application No. 12/932,652, filed on Mar. 2, 2011.

(30) Foreign Application Priority Data

Oct. 15, 2010 (JP) ..... 2010-232104

(51) Int. Cl.
*B65H 37/04* (2006.01)

(52) U.S. Cl. ..... 270/58.08; 270/58.07

(58) Field of Classification Search ..... 270/58.07, 270/58.08, 58.11; 399/407, 408, 410
See application file for complete search history.

(56) References Cited

U.S. PATENT DOCUMENTS

| | | | | |
|---|---|---|---|---|
| 7,296,788 | B2 * | 11/2007 | Terao et al. | 270/58.08 |
| 7,527,254 | B2 * | 5/2009 | Tamura et al. | 270/58.07 |
| 7,552,917 | B2 * | 6/2009 | Hayashi et al. | 270/58.12 |
| 7,694,966 | B2 * | 4/2010 | Nagasako et al. | 271/303 |
| 2010/0258995 | A1 * | 10/2010 | Okamoto et al. | 270/58.08 |

* cited by examiner

*Primary Examiner* — Leslie A Nicholson, III
(74) *Attorney, Agent, or Firm* — Flynn, Thiel, Boutell & Tanis, P.C.

(57) ABSTRACT

A sheet-processing device for performing various sheet post-processing functions at high speed and implementing a compact structure includes a compiler 106 that causes a stacked sheet to wait until stapling processing is performed; a jogger 107 that aligns the sheet stacked on the compiler 106; a stapler device 24 that performs the stapling processing to the sheet aligned by the jogger 107 as many as the setting number of sheets; and a sheet transfer pathway 105 through which the sheet in which an image is formed is delivered to the compiler 106.

4 Claims, 9 Drawing Sheets

SHEET PROCESSING DEVICE

This is a divisional of prior U.S. application Ser. No. 12/932,652, filed Mar. 2, 2011.

BACKGROUND OF THE INVENTION

1. Field of the Invention

The present invention relates to a sheet processing device that reprocesses a sheet discharged from an image-forming apparatus such as a printer, a copying machine, and a printing machine.

2. Description of the Related Art

In some cases, the image-forming apparatus includes the sheet processing device that reprocesses the sheet discharged from the image-forming apparatus. Conventionally, for example, in the sheet processing device disclosed in Japanese Patent Application Laid-Open No. 2003-312934, the sheet discharged from the image-forming apparatus is transferred through a sheet return module, the sheet is punched with a punching machine or the sheets are stapled with a stapler, and the sheet is stacked on a stacker tray.

Although some sheet processing devices include punching functions or stapling functions, only the punching processing or the stapling processing is independently performed, the punched sheets cannot be stapled and stacked on the stacker tray. Therefore, various pieces of sheet post-processing cannot be exerted.

Although various pieces of sheet post-processing can be exerted when the punched sheets are stapled and stacked on the stacker tray, because a punching processing speed differs from a stapling processing speed, it is necessary to adjust the a punching processing speed and the stapling processing speed.

Additionally, because the sheet processing device is disposed while connected to the image-forming apparatus, there is a restriction to an installation space of the sheet processing device, and the apparatus is enlarged in the configuration including the stapling function and the punching function.

SUMMARY OF THE INVENTION

In view of the foregoing, an object of the invention is to provide a sheet-processing device that can perform various sheet post-processing functions at high speed and implement a compact structure.

In order to solve the problem to achieve the object, the invention is configured as follows.

According to a first aspect of the invention, a sheet processing device includes: a compiler that causes stacked sheets to wait until stapling processing is performed; a jogger that aligns the sheets stacked on the compiler; a stapler device that performs the stapling processing to the sheets aligned by the jogger as many as the setting number of sheets; and a sheet transfer pathway through which the sheets on which an image is formed is delivered to the compiler, wherein an entrance roller and a discharge roller are disposed in the sheet transfer pathway, an approach detecting sensor, a punching machine, a sheet detecting sensor, and a buffer device are disposed between the entrance roller and the discharge roller, the approach detecting sensor detects the sheet that has approached the sheet transfer pathway, the punching machine makes a hole in the sheet by punching, the sheet detecting sensor detects the sheet that is discharged from the punching machine while the hole is made in the sheet, the buffer device buffers and stacks at least one sheet in which the hole is made and then transfers the sheet to the compiler, the punching machine is driven based on detection information of the approach detecting sensor, and the sheet processing device includes a controller device that sets the buffer storage setting number of the sheets that are stacked and temporarily retained, performs computation based on the detection information of the sheet detecting sensor, and drives the buffer device to transfer the stacked and temporarily retained sheets when the number of stacked sheets reaches the buffer storage setting number.

In the sheet processing device according to a second aspect of the invention, preferably the controller device includes a buffer storage number setting unit for setting the buffer storage setting number by performing the computation based on at least a sheet conveying speed and a sheet supply time interval.

In the sheet processing device according to a third aspect of the invention, preferably the buffer storage number setting unit sets the buffer storage setting number to one unless the sheet is transferred to the compiler to perform the stapling processing.

In the sheet processing device according to a fourth aspect of the invention, preferably the controller device drives the buffer device to transfer the stacked and temporarily retained sheets to the compiler and transfers individually the residual sheets as many as the number of sheets for which the stapling processing is required the compiler without passing through the buffer device, when the stapler device is driven to perform the stapling processing to the aligned sheets as many as the setting number of sheets to discharge the stapled sheets.

In the sheet processing device according to a fifth aspect of the invention, preferably, even if the number of sheets does not reach the setting number of sheets to which the stapling processing is performed, the controller device drives the jogger to align the sheets one by one every time a sheet is transferred to the compiler until the number of sheets reaches the setting number of sheets.

In the sheet processing device according to a sixth aspect of the invention, preferably the punching machine and the buffer device are disposed in order along a sheet transfer direction, the buffer device includes: a buffer tray that can stack and temporarily retain the transferred sheets in which a hole is made; and a sheet discharge unit for discharging the sheets on the buffer tray in a direction of the compiler, the sheet discharge unit is configured to discharge the sheets on the buffer tray obliquely upward to deliver the sheets to the discharge roller, the compiler is disposed below a portion in which the sheet is discharged from the discharge roller, and the stapler device is disposed below the discharge roller.

In the sheet processing device according to a seventh aspect of the invention, preferably the controller device includes a punching presence mode in which the punching machine makes the hole in the sheet and the a punching absence mode in which the punching machine is not driven, and the punching presence mode and the punching absence mode can be switched by a mode setting unit.

In the sheet processing device according to an eighth aspect of the invention, preferably the controller device starts to drive the punching machine after a predetermined time elapses based on the detection information of the approach detecting sensor.

In the sheet processing device according to a ninth aspect of the invention, preferably the punching machine includes a punch mechanism that makes the hole in the sheet and a conveyer belt that holds punching waste, the punch mechanism is driven by a motor, and the conveyer belt is driven by the motor.

Accordingly, in the above-described configurations, the invention has the following effects.

According to the first aspect of the invention, the buffer storage setting number of sheets that are stacked and temporarily retained is set to perform the computation based on the detection information of the sheet detecting sensor, the buffer device is driven to transfer the stacked and temporarily retained sheets to the compiler when the number of stacked sheets reaches the buffer storage setting number of sheets. Therefore, various sheet post-processing functions can be exerted at high speed and the compact structure can be implemented.

According to the second aspect of the invention, the buffer storage setting number of sheets is set by performing the computation based on at least the sheet conveying speed and the sheet supply interval, so that various sheet post-processing functions can be exerted.

According to the third aspect of the invention, unless the sheet is transferred to the compiler to perform the stapling processing to the sheet, the buffer storage setting number of the sheet is set to one, which allows the processing to be quickly performed.

According to the fourth aspect of the invention, when the stapler device is driven to perform the stapling processing to the aligned sheets as many as the staple setting number of sheets to discharge the stapled sheets while the sheets are stored in the buffer device, the buffer device is driven to transfer the stacked and temporarily retained sheets to the compiler and transfers individually the residual sheets as many as the number of sheets for which the stapling processing is required to the compiler without passing through the buffer device, so that the quick processing can be performed according to the stapling processing.

According to the fifth aspect of the invention, even if the number of sheets does not reach the staple setting number of sheets to which the stapling processing is performed, the jogger is driven to align the sheets one by one every time a sheet is transferred to the compiler until the number of sheets reaches the setting number of sheets, so that the stapling processing can immediately be performed when the number of sheets reaches the staple setting number of sheets to which the stapling processing is performed.

According to the sixth aspect of the invention, the punching machine and the buffer device are disposed in order along a sheet transfer direction, the sheet discharge unit is configured to discharge the sheet on the buffer tray obliquely upward to deliver the sheet to the discharge roller, the compiler is disposed below a portion in which the sheet is discharged from the discharge roller, and the stapler device is disposed below the discharge roller. Therefore, the compact structure is implemented by utilizing the surrounding of the sheet transfer pathway.

According to the seventh aspect of the invention, the punching presence mode and the punching absence mode can be switched by the mode setting unit, and the punching processing can selectively be performed.

According to the eighth aspect of the invention, the driving of the punching machine is started after the predetermined time elapses based on the detection information of the approach detecting sensor, and the punching processing can securely be performed by the simple structure without deviating the hole position.

According to the ninth aspect of the invention, the punch mechanism is driven by the motor, and the conveyor belt is driven by utilizing the motor. Therefore, the conveyor belt is driven while the motor is driven to actuate the punch mechanism, and the driving of the conveyor belt is stopped while the punch mechanism is not actuated, and the punching waste that falls on the conveyor belt is automatically discharged in order. Because the conveyor belt is driven by the motor that drives the punch mechanism, it is not necessary to separately provide a motor in order to drive the conveyor belt.

DETAILED DESCRIPTION OF THE INVENTION

A sheet processing device according to an embodiment of the invention will be described below. The embodiment of the invention indicates the best mode of the invention by way of example, but the invention is not limited to the embodiment.

Figure 1:
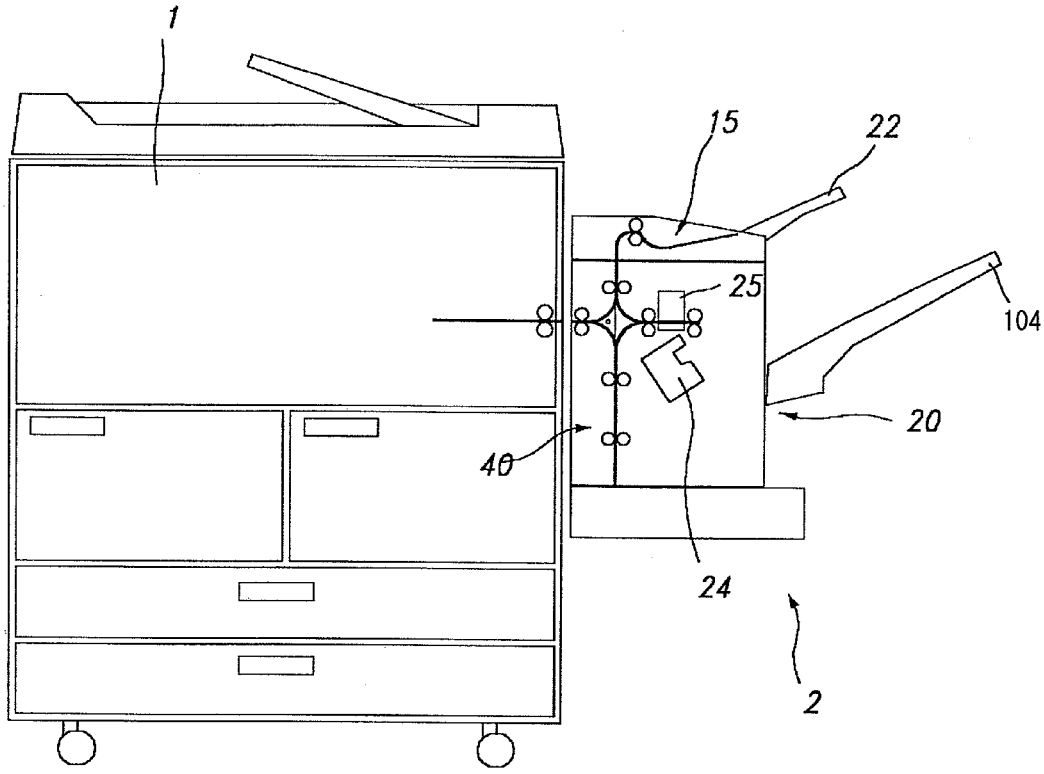
FIG. 1 is a view illustrating a structure of a general sheet processing device included in an image-forming apparatus.

FIG. 1 is a view illustrating a structure of a sheet processing device included in an image-forming apparatus. In the embodiment, generally an image-forming apparatus such as a copying machine 1 includes a sheet processing device 2 in a side portion of the image-forming apparatus, and the sheet processing device 2 performs post-processing to a sheet that is discharged from the image forming apparatus while an image is formed in the sheet.

The sheet processing device 2 includes various models such as an upper tray discharge model 15, a sheet processing model 20, and a return model 40. The upper tray discharge model 15 stacks the copied sheet on an upper tray 22. The sheet processing model 20 is configured to punch the sheets to which copying work is completed using a punching machine 25, staple the sheets using a stapler device 24, and stack the sheets on a stack tray 104. The return model 40 distributes the sheets to the upper tray discharge model 15 and the sheet processing model 20.

Figure 2:
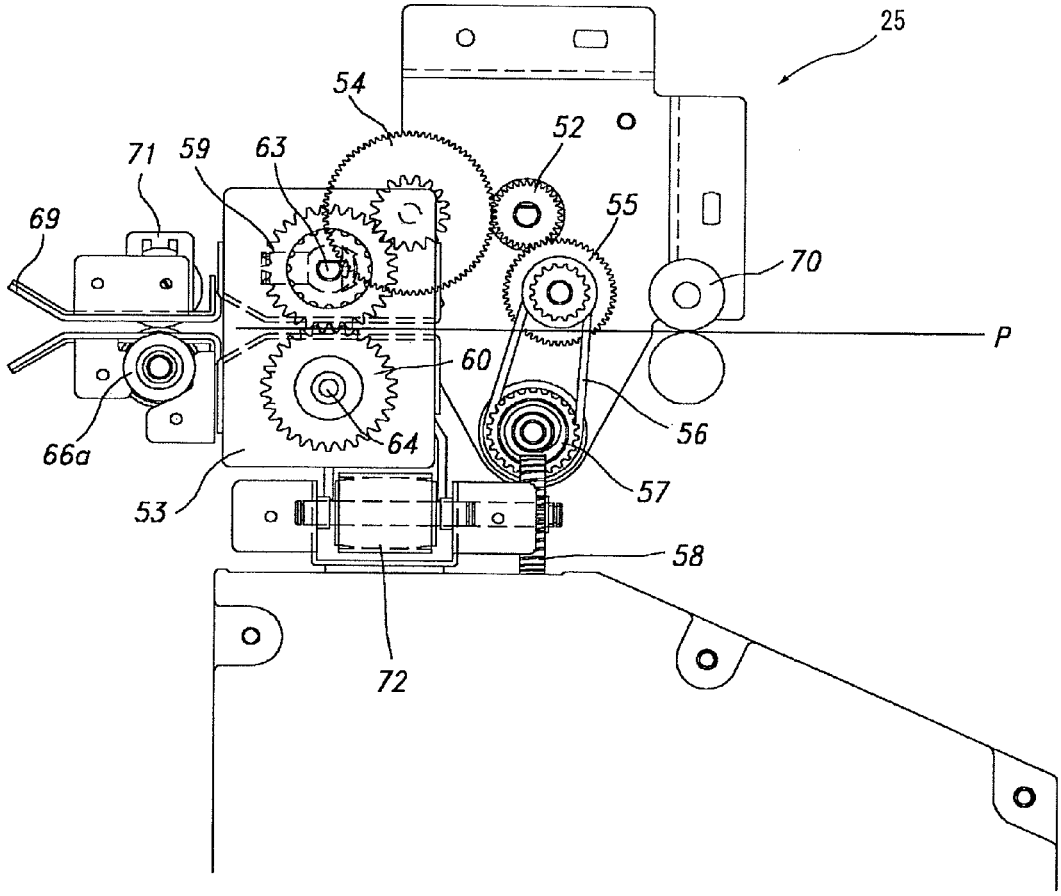
FIG. 2 is a sectional view illustrating a structure of a punching machine.
Figure 3:
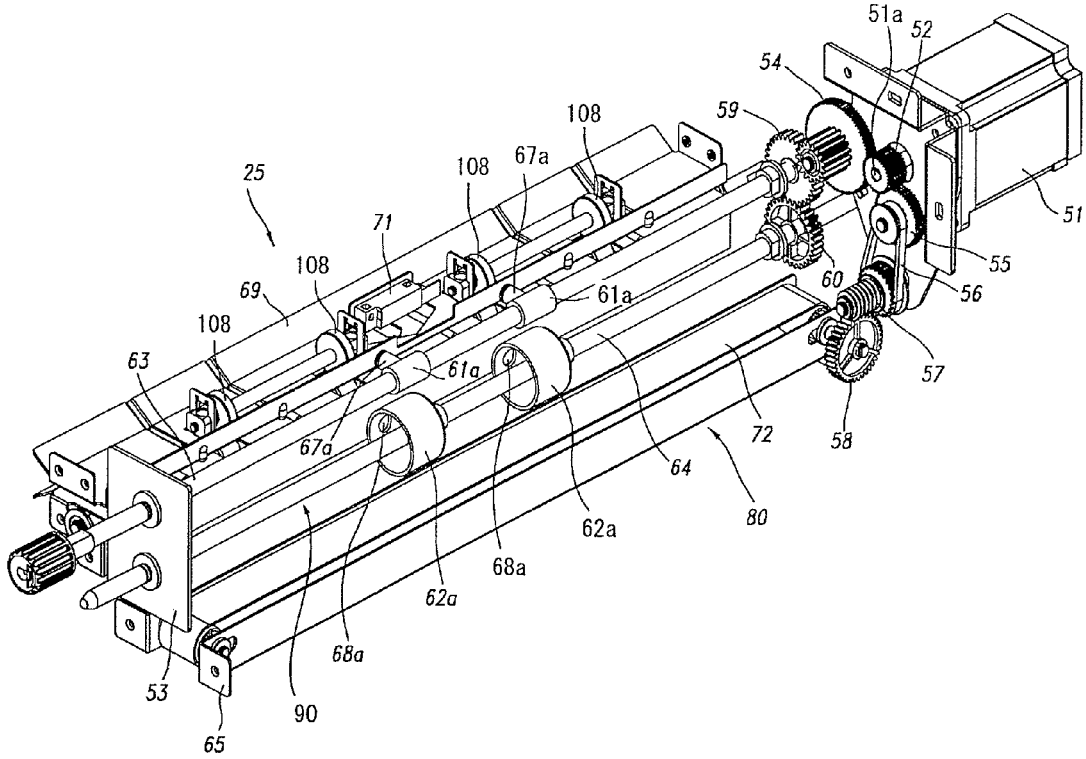
FIG. 3 is a perspective view illustrating the structure of the punching machine.

The punching machine 25 is configured as illustrated in FIGS. 2 and 3. FIG. 2 is s sectional view of the punching machine, and FIG. 3 illustrates a perspective view of the punching machine.

The punching machine 25 of the embodiment includes a punch mechanism 90 that makes a hole in the sheet. In the punch mechanism 90, a lower fixed shaft 64 and an upper fixed shaft 63 are vertically provided opposite each other so as to be disposed in line with respect to a support plate 53. Although both the support plates 53 are provided so as to support the lower fixed shaft 64 and the upper fixed shaft 63, the support plate 53 provided on a side of a motor 51 is not illustrated in the drawings for the sake of convenience.

In the lower fixed shaft 64, plural female punches 62*a* are disposed at a constant distance. In the upper fixed shaft 63, plural male punches 61*a* are disposed in positions corresponding to the female punches 62*a*, respectively. A circularly projected blade 67*a* is provided on the male punch 61*a*, a circling blade 68*a* is provided in the female punch 62*a*, and the hole is made in a sheet P by the punching with the circularly projected blade 67*a* and the circling blade 68*a*.

In the upper fixed shaft 63, a punch gear 59 is disposed in a side end portion of the motor 51. In the lower fixed shaft 64, a punch gear 60 is disposed in a side end portion of the motor 51. The punch gear 59 and the punch gear 60 engage each other to rotate the upper fixed shaft 63 and the lower fixed shaft 64 in opposite directions to each other.

The punch gear 59 is configured to be driven by a motor gear 52 fixed to an output shaft 51*a* of the motor 51, and a punch reduction gear 54 is disposed between the punch gear 59 and the motor gear 52 to reduce the revolution speed of the punching machine 25.

A conveyor 80 is disposed below the lower fixed shaft 64 in a direction parallel to the lower fixed shaft 64, and punching waste of the sheet punched with the female punch 62*a* and male punch 61*a* falls on a conveyor belt 72 of the conveyor 80.

The conveyor belt 72 is disposed so as to be rotated by a conveyor driving gear 58 fixed to a conveyor base 65, and a pulley gear 55, a pulley worm 57, and a timing belt 56 are disposed between the conveyor driving gear 58 and the motor gear 52 such that the conveyor driving gear 58 is rotated at the same time as the motor gear 52 is rotated. The pulley worm 57 is disposed between the conveyor driving gear 58 and the motor gear 52, which allows the conveyor belt 72 to be rotated in the fixed axis directions of the lower fixed shaft 64 and the upper fixed shaft 63.

The punch mechanism 90 that makes the hole in the sheet and the conveyor belt 72 that retains the punching waste are provided in the punching machine 25, the punch mechanism 90 is driven by the motor 51, and the conveyor belt 72 is driven by utilizing the motor 51. Therefore, the system is configured such that the conveyor belt 72 is driven while the motor 51 is driven to actuate the punch mechanism 90 and such that the driving of the conveyor belt 72 is stopped while the punch mechanism 90 is not actuated, and the punching waste falling on the conveyor belt 72 is automatically discharged in order.

Plural entrance rollers 108 that can transfer the sheet P are disposed between the lower fixed shaft 64 and the upper fixed shaft 63, and an entrance guide 69 for the sheet is disposed in front of the entrance rollers 108. In the sheet passing by the entrance rollers 108, the rotation of the motor 51 is controlled by a signal from an approach detecting sensor 71, and the driving of the punching machine 25 is started based on detection information of the approach detecting sensor 71 after a predetermined time elapses, which allows the punching processing to be quickly started. A sensor that performs the detection in a non-contact manner is used as the approach detecting sensor 71. Alternatively, a sensor that performs the detection in a contact manner may be used as the approach detecting sensor 71.

When the sheet P passes between the lower fixed shaft 64 and the upper fixed shaft 63, that is, between the female punch 62*a* and the male punch 61*a* through the entrance guide 69 and the entrance rollers 108, the motor 51 is rotated by the detection signal of the approach detecting sensor 71, and the circularly projected blade 67*a* of the female punch 62*a* penetrates the circling blade 68*a* of the male punch 61*a* by the rotation of the motor 51, thereby punching the sheet passing between the female punch 62*a* and the male punch 61*a*.

The punching waste of the sheet P punched in the above-described way falls on the conveyor belt 72 that is rotated at the same time as the motor 51 is rotated, and the punching waste that falls on the conveyor belt 72 is sequentially discharged to the outside by driving the conveyor belt 72. Then, the punched sheet P is discharged through the transfer roller 70. As illustrated in FIG. 2, a transfer roller 70 is disposed on the opposite side to the entrance roller 108. However, the transfer roller 70 is not illustrated in FIG. 3.

The system of the punching machine 25 is configured such that the conveyor 80 that is driven by the motor 51 is disposed such that the punching waste is automatically discharged, such that the conveyor 80 is driven while the motor 51 of the punching machine 25 is rotated to actuate the punching machine 25, and such that the driving of the conveyor 80 is stopped while the punching machine 25 is not actuated. Therefore, the punching waste that falls on the conveyor 80 is automatically discharged to the outside of the sheet processing device 2 in order, which allows the function of the punching machine 25 to be improved.

Accordingly, the punching waste can automatically be discharged to the outside of the sheet processing device 2 without periodically opening a container that is separately disposed in the sheet processing device 2 to accommodate the punching waste. Because the conveyor belt 72 is driven by the motor 51 that drives the punch mechanism 90, it is not necessary to separately provide a motor that transmits a power to drive the conveyor belt 72.

The stapler device 24 of the embodiment is configured as illustrated in FIGS. 4 to 7. The stapler device 24 promotes efficient sheet reprocessing such that a sheet transferred through a sheet transfer path 105 is not delayed in the sheet reprocessing process or such that the sheet does not stand for a constant time.

The sheet processing device 2 includes a sheet transfer path 105, a buffer device 125, a compiler 106 that stacks the sheets transferred through the sheet transfer path 105, a jogger 107 that aligns the sheets stacked on the compiler 106, and the stapler device 24 that reprocesses the sheets aligned by the jogger 107. The sheets reprocessed by the stapler device 24 are discharged to and stacked on the stack tray 104.

The plural sheets, which are buffered by and stacked on a buffer device 125, are transferred from the sheet transfer path 105 to the compiler 106. A sheet transfer unit 140 such as a roller is disposed in the sheet transfer path 105. The sheet transfer unit 140 includes an entrance roller 108, the transfer roller 70, and discharge roller 118.

The approach detecting sensor 71, the punching machine 25, a sheet detecting sensor 133, and the buffer device 125 are disposed in order along a direction in which the sheet is transferred through the sheet transfer path 105. The approach detecting sensor 71 detects the sheet that approaches from the image-forming apparatus. The punching machine 25 makes the hole in the sheet. The sheet detecting sensor 133 detects the sheet that is discharged from the punching machine 25 while the hole is made. The buffer device 125 buffers and stacks at least one sheet in which the hole is made, and then the buffer device 125 transfers the stacked sheet to the compiler 106. A sensor that performs the detection in a non-contact manner is used as the sheet detecting sensor 133. Alternatively, a sensor that performs the detection in a contact manner may be used as the sheet detecting sensor 133.

The buffer device 125 includes a buffer tray 126 and a sheet discharge unit 120. The buffer tray 126 can stack and temporarily retain the transferred sheets in which the holes are made. The sheet discharge unit 120 discharges the sheets on the buffer tray 126 toward the compiler 106. A guide 134 is provided on the buffer tray 126 such that the transferred sheet P is pushed to the buffer tray 126 and precisely stacked on the buffer tray 126.

The sheet discharge unit 120 is configured to discharge the sheet on the buffer tray 126 obliquely upward to deliver the sheet to the discharge roller 118. The sheet discharge unit 120 includes a pressure roller 130 and an idle roller 128. The compiler 106 is disposed below a portion in which the sheet is discharged from the discharge roller 118, and the stapler 103 is disposed below the discharge roller 118. The length of a surface of the buffer tray 126 on which the sheet is stacked is formed longer than the length of a stacked sheet such that the sheet is not moved to the discharge roller 118 before the pressure roller 130 is actuated.

The punching machine 25 and the buffer device 125 are disposed in order along the sheet transfer direction, the buffer device 125 includes the buffer tray 126 that can stack and temporarily retain the transferred sheet in which the hole is made and the sheet discharge unit 120 for discharging the sheet on the buffer tray 126 toward the compiler, the sheet discharge unit 120 is configured to discharge the sheet on the buffer tray 126 obliquely upward to deliver the sheet to the discharge roller 118, and the compiler 106 is disposed below the portion in which the sheet is discharged from the discharge roller 118, the stapler device 24 is disposed below the discharge roller 118. Therefore, the compact disposition structure can be implemented by utilizing the surrounding of the sheet transfer pathway 105.

Figure 8:
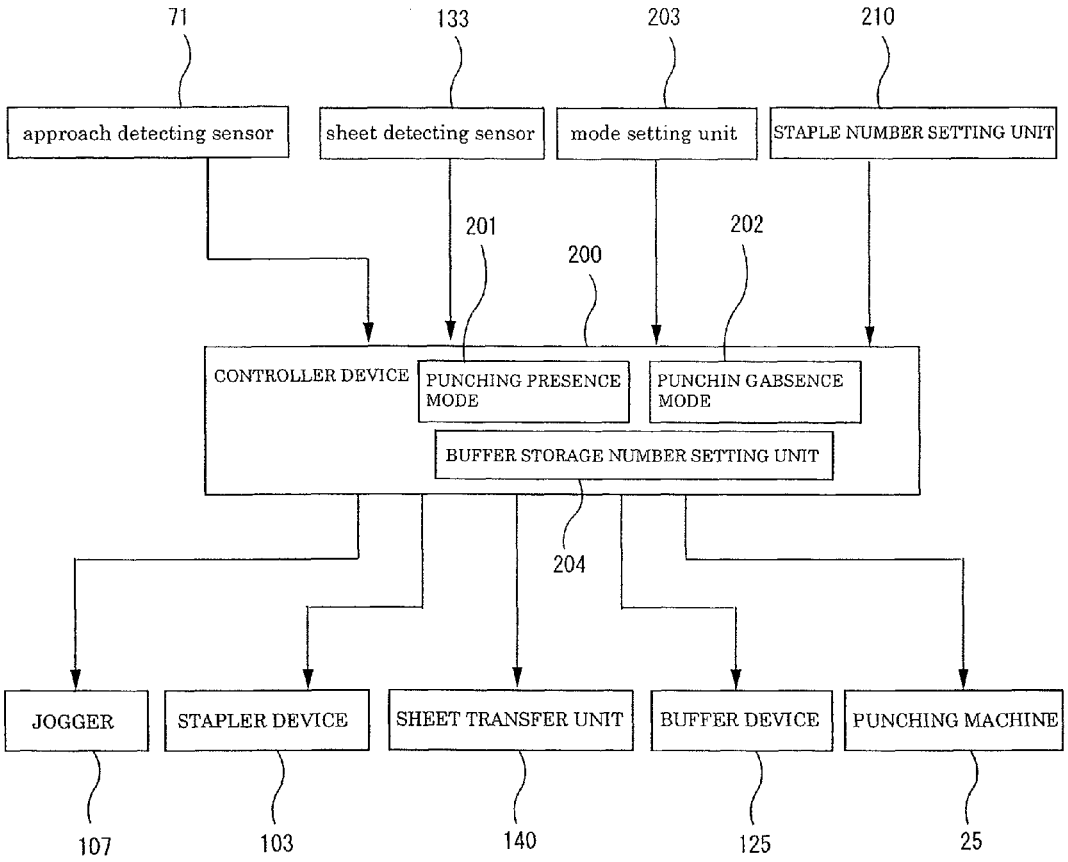
FIG. 8 is a block diagram illustrating a configuration of a controller of the sheet processing device.
Figure 9:
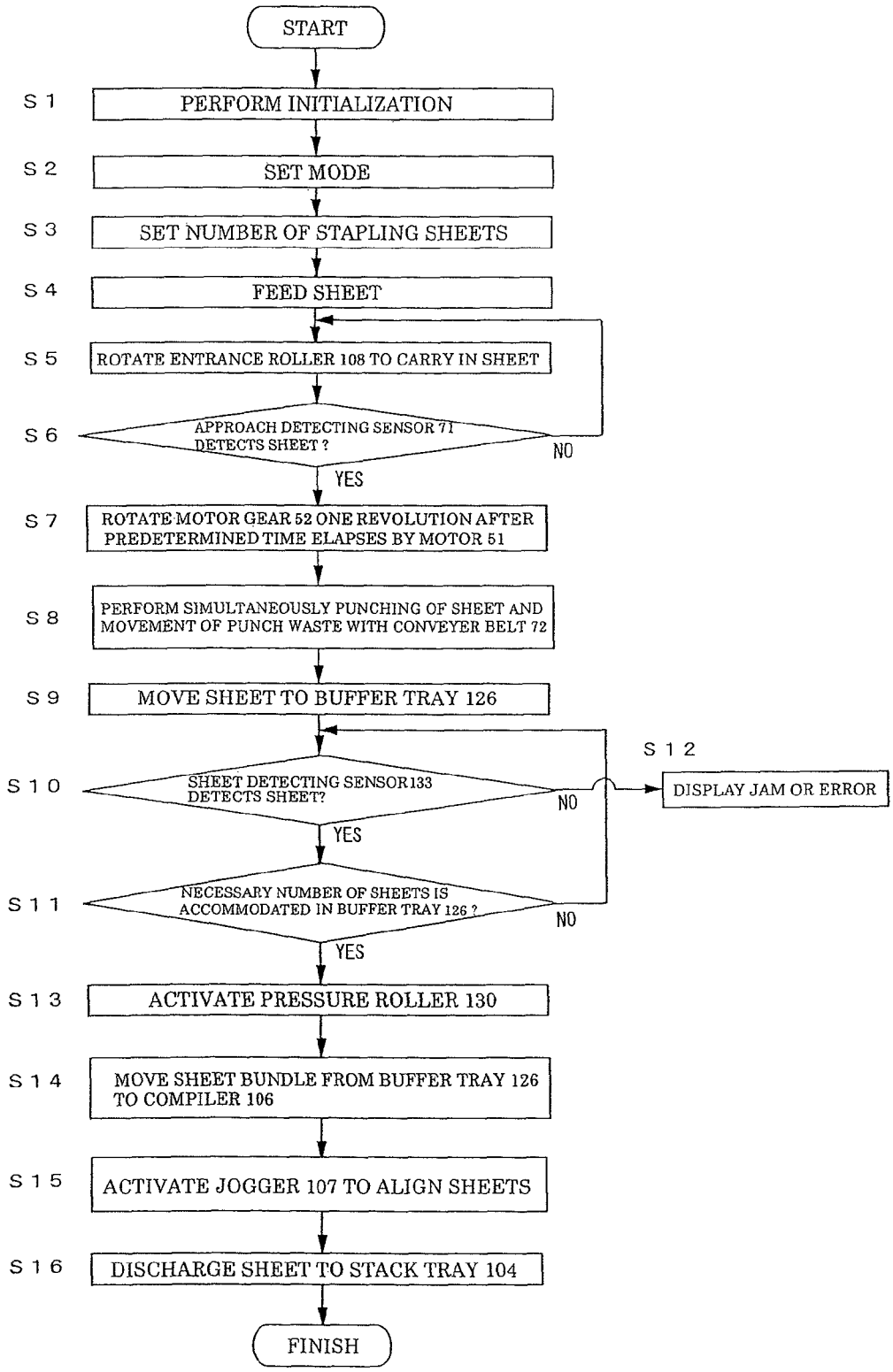
FIG. 9 is a flowchart illustrating an operation process of the sheet processing device.

FIG. 8 is a block diagram illustrating a configuration of a controller device of the sheet processing device, and FIG. 9 is a flowchart illustrating a sheet processing device operating process.

The sheet processing device 2 of the embodiment includes a controller device 200. The controller device 200 may be formed integral with the image-forming apparatus such as the copying machine 1, or the controller device 200 may be separately formed. The controller device 200 has a punching presence mode 201 and a punching absence mode 202 as a driving mode. In the punching presence mode 201, the punching machine 25 is driven to make the hole in the sheet, and the stapler 103 is driven to perform stapling processing. In the punching absence mode 202, the punching machine 25 is not driven, but the stapler 103 is driven to perform the stapling processing. The punching presence mode 201 and the punching absence mode 202 are realized by a program stored in a microcomputer, and the punching presence mode 201 and the punching absence mode 202 can be switched by a mode setting unit 203 to selectively perform punching processing.

In the punching presence mode 201, the controller device 200 drives the sheet transfer unit 140 disposed on the sheet transfer pathway 105 through which the sheet is delivered, and the controller device 200 drives the punching machine 25 based on the detection information of the approach detecting sensor 71. In the punching absence mode 202, the controller device 200 drives the sheet transfer unit 140 disposed on the sheet transfer pathway 105 through which the sheet is delivered, although the controller device 200 does not drive the punching machine 25 irrespective of the detection information of the approach detecting sensor 71.

The image-forming apparatus such as the copying machine 1 includes a staple number setting unit 210 for setting the number of sheets in a bundle to which the stapling processing is performed. The number of sheets in the bundle to which the stapling processing is performed is sent to the controller device 200 from the staple number setting unit 210. In the embodiment, the staple number setting unit 210 is included in the image-forming apparatus such as the copying machine 1. Alternatively, the staple number setting unit 210 may be included in the sheet processing device 2 instead of the image-forming apparatus. A user can freely set the number of sheets in a bundle to which the stapling processing is performed using the staple number setting unit 210.

The controller device 200 includes a buffer storage number setting unit 204 for setting the number of sheets stored in the buffer by performing a computation based on at least a sheet conveying speed and a sheet supply time interval. The buffer storage number setting unit 204 obtains the sheet conveying speed based on information on which the sheet-detecting sensor 133 detects a leading end of the sheet P to a rear end, and the buffer storage number setting unit 204 obtains the sheet supply time interval from information on a time until the leading end of the subsequent sheet P is detected since the rear end of the preceding sheet P is detected.

Thus, the buffer storage number setting unit 204 sets the number of sheets stored in the buffer based on the detection information of the sheet detecting sensor 133, that is, the buffer storage number setting unit 204 sets the number of sheets by performing the computation based on at least the sheet conveying speed and the sheet supply time interval. When the number of stacked sheets reaches the number of sheets stored in the buffer, the controller device 200 drives the buffer device 125 to transfer the stacked and temporarily retained sheets P to the compiler 106.

Unless the sheet P is transferred to the compiler 106 to perform the stapling processing, the buffer storage number setting unit 204 sets the number of sheets stored in the buffer to one so as not to actuate the buffer device 125, which allows the processing to be quickly performed.

When the stapler 103 is driven to perform the stapling processing to the aligned sheets P as many as the staple setting number of sheets to discharge the stapled sheets while the sheets P are stored in the buffer device 125, the controller device 200 drives the buffer device 125 to transfer the stacked and temporarily retained sheet P to the compiler 106, and the controller device 200 transfers the residual sheets P in the number of sheets to which the stapling processing is performed to the compiler 106 one by one, which allows the processing to be quickly performed according to the processing of the stapler 103.

Even if the number of sheets P does not reach the number of sheets to which the stapling processing is performed, the controller device 200 drives the jogger 107 to align the sheet P every time one sheet P is transferred to the compiler 106 until the number of sheets P reaches the number of sheets to which the stapling processing is performed, so that the stapling processing can immediately be performed when the number of sheets P reaches the number of sheets to which the stapling processing is performed.

Thus, in the punching presence mode 201, the punching machine 25 is driven based on the detection information of the approach detecting sensor 71, the buffer device 125 is driven based on the detection information of the sheet-detecting sensor 133, the sheet transfer unit 140 transfers the sheet to the compiler 106, the jogger 107 aligns the sheets stacked on the compiler 106, and the stapler 103 staples the sheets aligned by the jogger 107.

In the punching absence mode 202, although the punching machine 25 is not driven irrespective of the detection information of the approach detecting sensor 71, the buffer device 125 is driven based on the detection information of the sheet-detecting sensor 133, the sheet transfer unit 140 transfers the sheet to the compiler 106, the jogger 107 aligns the sheets stacked on the compiler 106, and the stapler 103 staples the sheets aligned by the jogger 107.

FIG. 9 is the flowchart illustrating the process of operating the sheet-processing device of the embodiment. The sheet-reprocessing process will specifically be described with reference to FIGS. 4 to 7.

The system of the sheet-processing device 2 is initialized (Step S1). In the driving mode of the sheet-processing device 2, the mode setting unit 203 sets one of the punching presence mode 201 and the punching absence mode 202 (Step S2). The staple number setting unit 210 sets the number of sheets of the bundle to which the stapling processing is performed (Step S3).

The sheet P is fed such that the sheet to be reprocessed is supplied to the always-driven entrance roller 108 (Step S4). The sheet P is transferred to the sheet transfer path 105 through the entrance roller 108 (Step S5). When the driving mode is set to the punching presence mode 201, the approach detecting sensor 71 detects the sheet passing through the entrance roller 108 (Step S6), the motor 51 of the punching machine 25 is driven by the detection signal of the approach detecting sensor 71 after a predetermined time elapses, and the motor gear 52 is rotated one revolution (Step S7).

The upper fixed shaft 63 and the lower fixed shaft 64 are rotated in the opposite directions to each other through the motor gear 52 by driving the motor 51, and the circularly projected blade 67*a* of the female punch 62*a* penetrates the circling blade 68*a* of the male punch 61*a*, thereby punching the sheet passing between the female punch 62*a* and the male punch 61*a*. The punching waste of the punched sheet P falls on the conveyor belt 72 that is rotated at the same time as the motor 51 is rotated, and the punching waste that falls on the conveyor belt 72 is sequentially discharged to the outside by driving the conveyor belt 72 (Step S8).

The punched sheet P is transferred to the buffer tray 126 through the transfer roller 70 (Step S9).

When the sheet P is transferred to the buffer tray 126, the sheet-detecting sensor 133 is actuated to detect the sheet P (Step S10), and the sheets P as many as the number of sheets set are stacked on the buffer tray 126 (Step S11).

In the process of actuating the sheet-detecting sensor 133, when a jam of the sheet or a sheet transfer error is generated in the sheet transfer path 105, the jam or error of the sheet is displayed (Step S12), and the sheet-processing device stands by until the user of the sheet-processing device 2 releases the jam or error of the sheet.

Figure 4:
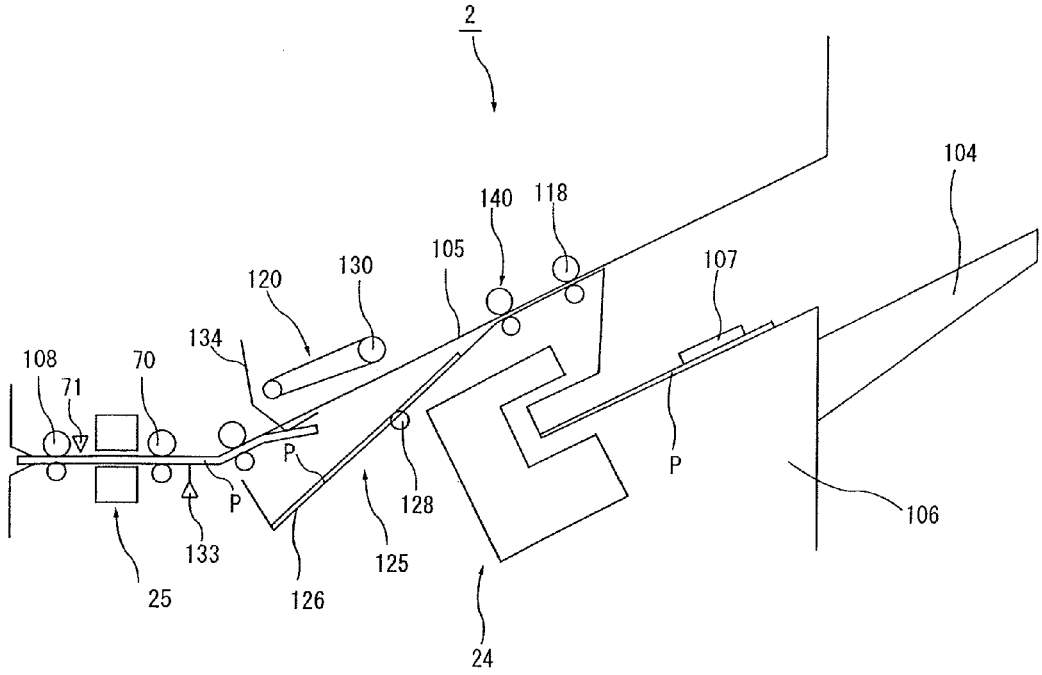
FIG. 4 is a view illustrating a buffering process of the sheet processing device.
Figure 5:
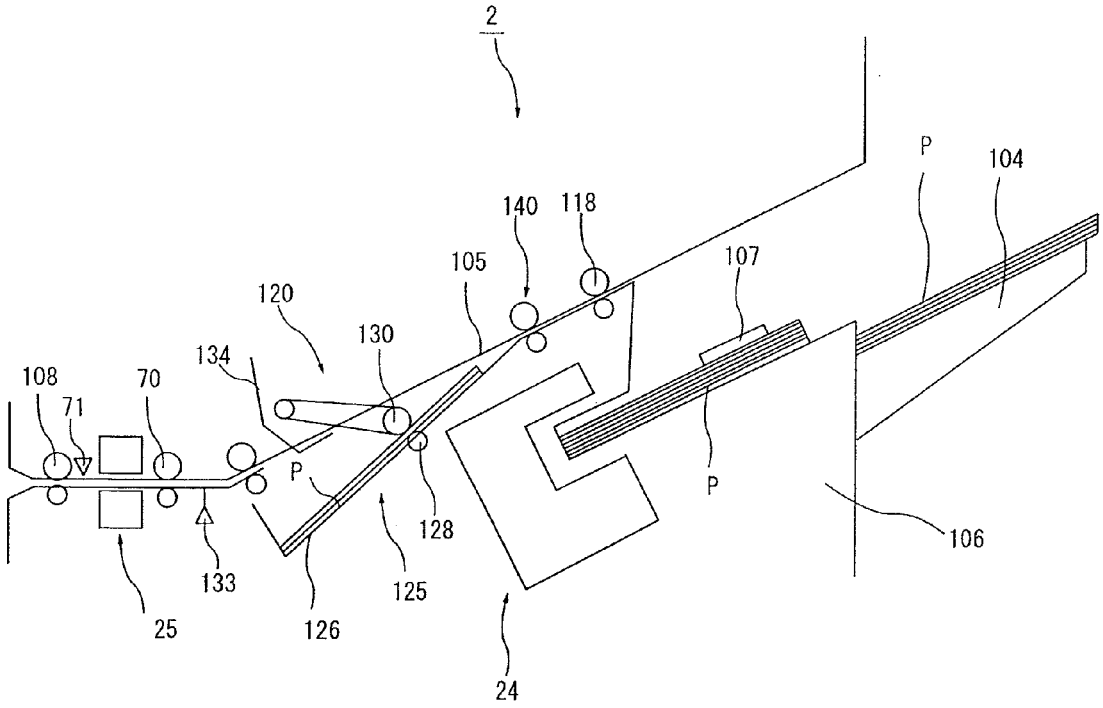
FIG. 5 is a view illustrating a transfer structure of a buffered sheet.
Figure 6:
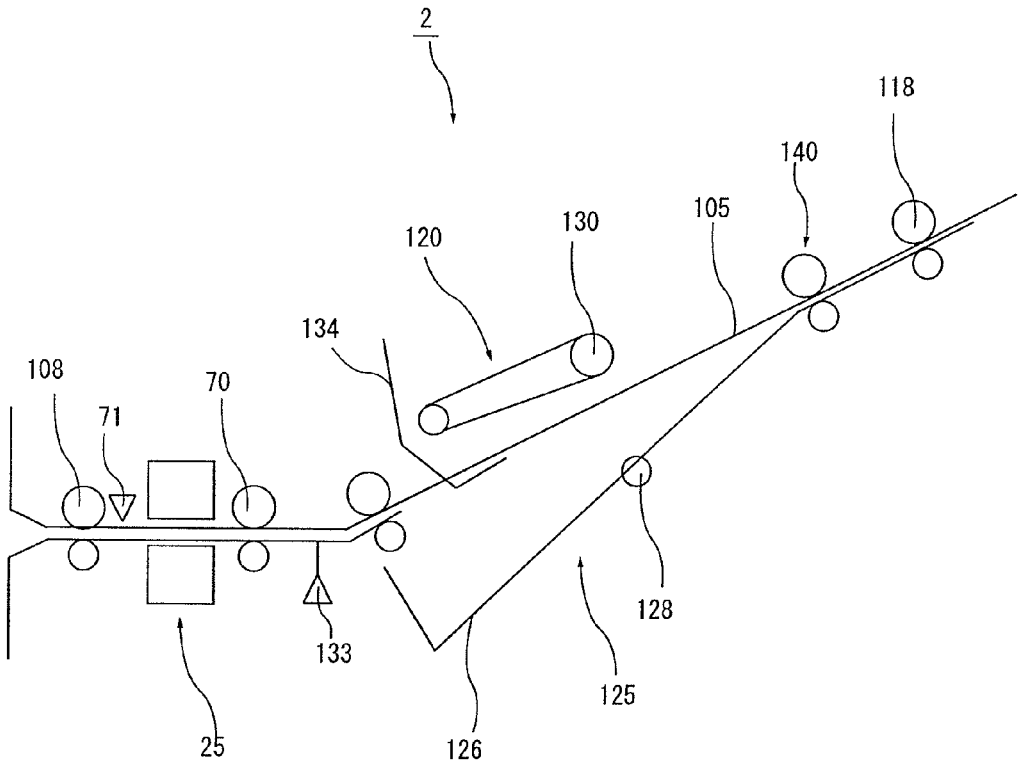
FIG. 6 is a view illustrating a structure that controls an operation of a pressure roller of a buffer device.

The buffer storage number setting unit 204 sets the number of sheets stacked on the buffer tray 126 based on the detection information of the sheet-detecting sensor 133, that is, the buffer storage number setting unit 204 sets the number of sheets by performing the computation based on at least the sheet conveying speed and the sheet supply time interval. As illustrated in FIG. 4, the state in which the pressure roller 130 is retreated from the idle roller 128 is maintained to stack the sheet on the buffer tray 126 until the number of sheets becomes the buffer storage setting number. Then, when the sheets as many as the buffer storage setting number are stacked on the buffer tray 126, the pressure roller 130 is actuated as illustrated in FIG. 5 (Step S13), and the pressure roller 130 is driven while brought into contact with the idle roller 12, whereby the sheets P stored on the buffer tray 126 are transferred in the direction of the discharge roller 118 that is always driven in the driving mode of the sheet-processing device 2.

When the leading end of the sheet P transferred by the actuation of the pressure roller 130 is started to be transferred by the contact force of the discharge roller 118 while passing through the entrance of the discharge roller 118, the pressure roller 130 is moved to the original position before the leading end of the first sheet of the next buffering reaches the position of the pressure roller 130 since passing through the entrance roller 108.

That is, after delivering the leading end of the sheet P to be buffered toward the discharge roller 118, the pressure roller 130 is immediately moved to the original position such that the transfer delay of the first sheet of the next buffering is not generated.

The sheet transferred to the discharge roller 118 is transferred to the compiler 106 (Step S14), the sheet is tacked on the compiler 106, and the jogger 107 is actuated to align the sheets stacked on the compiler 106 when the number of stacked sheets reaches the predetermined number of sheets to be reprocessed (Step S15). Even if the number of sheets does not reach the staple setting number, the jogger 107 is driven to align the sheet every time a sheet P is transferred to the compiler 106 until the number of sheets reaches the staple setting number, which allows the stapling processing to be immediately performed when the number of sheets reaches the number of sheets of the bundle to which the stapling processing is performed.

The sheets aligned on the compiler 106 are reprocessed by the stapler 103, and the reprocessed sheets are discharged to and stacked on the stack tray 104 (StepS16). When the sheets stacked on the compiler 106 are reprocessed while the sheets are discharged to the stack tray 104, the jogger 107 is actuated to align the sheets. While the sheets are discharged to the stack tray 104 after the stapling processing, the sheet transferred through the entrance roller 108 is stacked on the buffer tray 126 to perform the buffering, and the sheets buffered on the buffer tray 126 can be transferred by the compiler 106 when the reprocessing process is ended on the compiler 106.

Accordingly, because the sheets transferred through the entrance roller 108 are supplied at fixed time intervals without a standby time, a loss of a working time generated in the process of reprocessing the sheets is eliminated to largely improve the sheet transfer efficiency of the sheet processing device.

Figure 7:
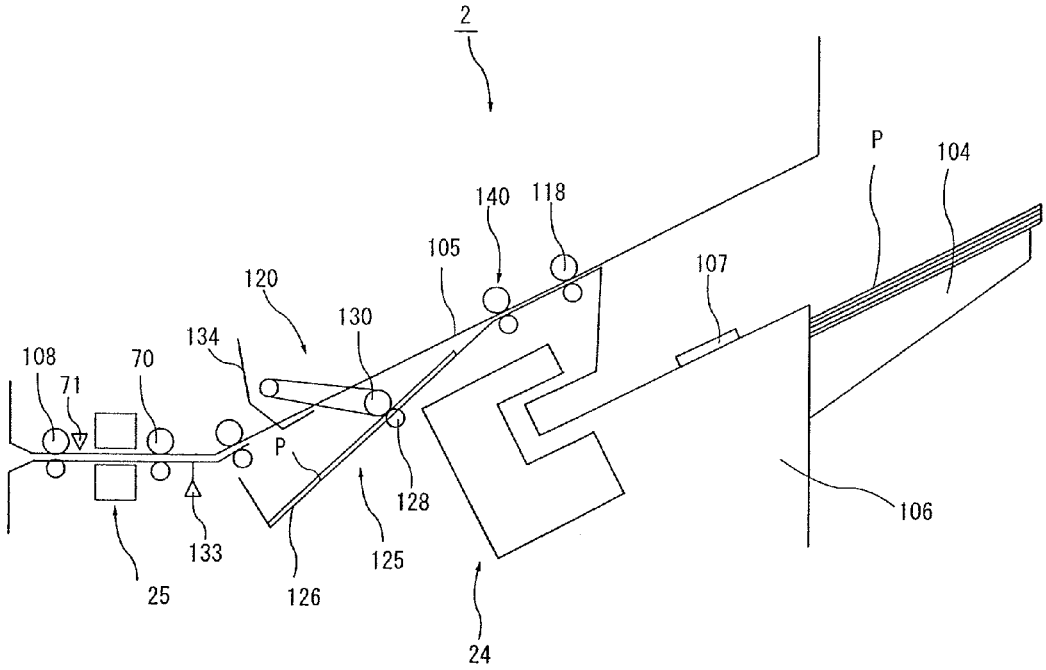
FIG. 7 is a view illustrating a transfer structure of the sheet in a mode in which reprocessing is not performed to the sheet.

Obviously the operation timing setting of the pressure roller 130, that is, the sheet buffering number setting is properly adjusted according to the sheet reprocessing time on the compiler 106. Unless the sheet is transferred to the compiler 106 to perform the reprocessing, the buffer storage number setting unit 204 of the controller device 200 sets the buffer storage number of the sheets to one. Therefore, as illustrated in FIG. 7, the sheet P that enters the buffer device 125 through the sheet transfer path 105 is not stacked on the buffer tray 126, but the pressure roller may be brought into contact with the idle roller 128 such that the sheet P is immediately discharged to the stack tray 104.

The buffer storage setting number of stacked and temporarily retained sheets P is set to perform the computation based on the detection information of the sheet-detecting sensor 133, and the buffer device 125 is driven to transfer the stacked and temporarily retained sheet P to the compiler 106 when the number of stacked sheets reaches the buffer storage setting number. Therefore, various sheet post-processing functions can be exerted at high speed and the compact structure can be implemented.

The punching presence mode 201 and the punching absence mode 202 can be switched, and the punching processing can selectively be performed. FIG. 9 is a flowchart illustrating the process of operating the sheet-processing device 2 in the punching presence mode 201. In the punching absence mode 202, Steps S6 to S8 are omitted, and the actuation similar to that of the punching presence mode 201 is performed from Step S9.

In the buffer device 125 of the embodiment, the buffer tray 126 is disposed between the entrance roller 108 and the discharge roller 118 of the sheet transfer path 105, the pressure roller 130 that can be brought into contact with and separated from the idle roller 128 is disposed above the buffer tray 126, and the pressure roller 130 is brought into contact with the idle roller 128 when the sheets as many as the predetermined number are stacked on the buffer tray 126, so that the sheets stacked on the buffer tray 126 can be moved at once in the direction of the discharge roller 118.

In the sheet-reprocessing process, the delay of the sheet transferred through the entrance roller 108 or the sheet waiting for a constant time can be eliminated to advantageously improve the sheet-reprocessing efficiency. Further, the sheet supplied through the sheet transfer path 105 is supplied and discharged at an even rate irrespective of the sheet alignment operation and reprocessing operation of the sheet-processing device.

The invention can be applied to the sheet-processing device that reprocesses the sheet discharged from the image-forming apparatus such as the printer, the copying machine, and the printing machine, and the invention can exert various sheet post-processing functions and implement the compact structure.

DESCRIPTION OF LETTERS OR NUMERALS

1 copying machine
2 sheet-processing device
24 stapler device
25 punching machine
51 motor
52 motor gear
54 punch reduction gear
55 pulley gear
56 timing belt
57 pulley worm
58 conveyor driving gear
59, 60 punch gear
61*a* male punch
62*a* female punch
63 upper fixed shaft
64 lower fixed shaft
65 conveyor base
67*a* circularly projected blade
68*a* circling blade
71 approach detecting sensor
70 transfer roller
72 conveyor belt
80 conveyor
90 punch mechanism
103 stapler
105 sheet transfer pathway
106 compiler
107 jogger
108 entrance roller
118 discharge roller
120 sheet discharge unit
125 buffer device
126 buffer tray
133 sheet-detecting sensor
200 controller device
201 punching presence mode
202 punching absence mode
203 mode setting unit
204 storage number setting unit

What is claimed is:

1. A sheet processing device comprising a punching machine and a buffer device disposed in order along a direction in which a sheet is transferred, the punching machine including a punch mechanism for making a hole in the sheet and a conveyor belt for holding punching waste, the punch mechanism and conveyor belt being driven by a motor, the buffer device including:

a buffer tray for stacking and temporarily retaining the transferred sheet in which the hole is made and a sheet discharge unit for discharging the sheet on the buffer tray in a direction to a compiler, the sheet discharge unit being configured to discharge the sheet on the buffer tray obliquely upward to deliver the sheet to a discharge roller and the compiler being disposed below a portion in which the sheet is discharged from the discharge roller, and a stapler device is disposed below the discharge roller.

2. The sheet processing device according to claim 1, wherein the paper discharge unit is formed of a pressure roller that is disposed at a position above the buffer tray and applies pressure to the sheet stacked on the buffer tray from above and an idle roller disposed in a bottom portion of the buffer tray and supports the sheet stacked on the buffer tray from below, and the sheet stacked on the buffer tray is held by the pressure roller and the idle roller and fed to the discharge roller.

3. The sheet processing device according to claim 1, wherein, in the buffer device, the position from which the sheet is transferred to the buffer tray is set higher than the position from which the sheet stacked on the buffer tray is discharged in the direction to the compiler.

4. The sheet processing device according to claim 1, wherein a guide for guiding the sheet to be transferred to the buffer tray is provided at a position above the buffer tray.

* * * * *